US006824504B2

(12) United States Patent
Ott

(10) Patent No.: US 6,824,504 B2
(45) Date of Patent: Nov. 30, 2004

(54) FULL BODY, ADJUSTABLE WEIGHT SLED EXERCISER

(76) Inventor: Wayne G. Ott, 1229 N. Troxell St., Allentown, PA (US) 18109

( * ) Notice: Subject to any disclaimer, the term of this patent is extended or adjusted under 35 U.S.C. 154(b) by 533 days.

(21) Appl. No.: 10/025,016

(22) Filed: Dec. 19, 2001

(65) Prior Publication Data

US 2002/0077226 A1 Jun. 20, 2002

Related U.S. Application Data

(60) Provisional application No. 60/256,601, filed on Dec. 19, 2000.

(51) Int. Cl.[7] ..... A63B 69/34
(52) U.S. Cl. ..... 482/92; 473/445; 473/438
(58) Field of Search ..... 482/92–101; 473/445, 473/415, 438, 437, 441, 442, 443, 444

(56) References Cited

U.S. PATENT DOCUMENTS

| | | | | | |
|---|---|---|---|---|---|
| 3,889,949 | A | * | 6/1975 | Gardner | 473/445 |
| 4,316,608 | A | | 2/1982 | Lundberg | |
| 4,890,495 | A | * | 1/1990 | Slane | 73/379.06 |
| 4,943,051 | A | | 7/1990 | Haskins et al. | |
| 5,853,355 | A | | 12/1998 | Standish | |
| 6,093,119 | A | * | 7/2000 | Tipton | 473/438 |
| 6,387,015 | B1 | * | 5/2002 | Watson | 482/54 |

* cited by examiner

*Primary Examiner*—Glenn E. Richman
(74) *Attorney, Agent, or Firm*—Wendy W. Koba

(57) ABSTRACT

A sled exerciser used, for example, in tackling or blocking practice in football training, comprises a sled, slidably attached to a frame, where the sled includes padding on one side. An adjustable weight mechanism is attached to the sled and provides continuous resistance against an individual as the sled is pushed, as in tackle/blocking practice.

5 Claims, 3 Drawing Sheets

FULL BODY, ADJUSTABLE WEIGHT SLED EXERCISER

CROSS REFERENCE TO RELATED APPLICATION

This application claims the benefit of Provisional Application No. 60/256,601, filed Dec. 19, 2000.

TECHNICAL FIELD

The present invention relates to a sled exerciser and, more particularly, to a full body, adjustable weight sled exerciser included within a stationary frame so as to be used indoors.

BACKGROUND OF THE INVENTION

In sports, primary in football, a sled exerciser is used for tackle and blocking training, with a coach or trainer standing on a frame and the individual running into a padded arm and pushing the frame backwards, using the weight of the coach or trainer as the resistance. Obviously, such an arrangement cannot be used indoors, as during off-season practice or during inclement weather. Moreover, the weight used as resistance is not well-controlled and cannot be assured in providing the proper workout for the individual. Thus, a need remains in the art for an exercise sled, useful (for example) in tackle training, that can be used indoors and utilizes a proper, well-controlled means of resistance against the individual making the tackle/block.

SUMMARY OF THE INVENTION

The need remaining in the prior art is addressed by the present invention, which relates to a sled exerciser and, more particularly, to a full body, adjustable weight sled exerciser included within a stationary frame so as to be used indoors.

In accordance with the present invention, a padded vertical bar (i.e., sled) is mounted within a three-sided heavy-duty frame assembly, with the bar connected to an overhead track assembly that rides along a C-channel member from the front to the back of the assembly. In accordance with the present invention, a set of pulley-mounted weights are attached to the overhead track assembly and used to provide resistance against the individual pushing against the padded sled. Advantageously, the weight is adjusted to provide the proper workout for the individual using the system (i.e., a lower set of weight for youths, and a large weight resistance for adults/professionals).

In a preferred embodiment of the present invention, the pulley-mounted weights are attached to a second, front frame member which extends beyond the frame assembly supporting the sled. In this embodiment, the weights remain easily accessible, yet out of the way of someone using the system.

The pad on the vertical bar may be adjustable, or interchangeable with longer (or shorter) pads, as necessary. Alternatively, a fixed, relatively long pad may be used. In any case, padding is required to prevent injury to someone using the system.

Other and further embodiments and advantages of the system of the present invention will become obvious during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
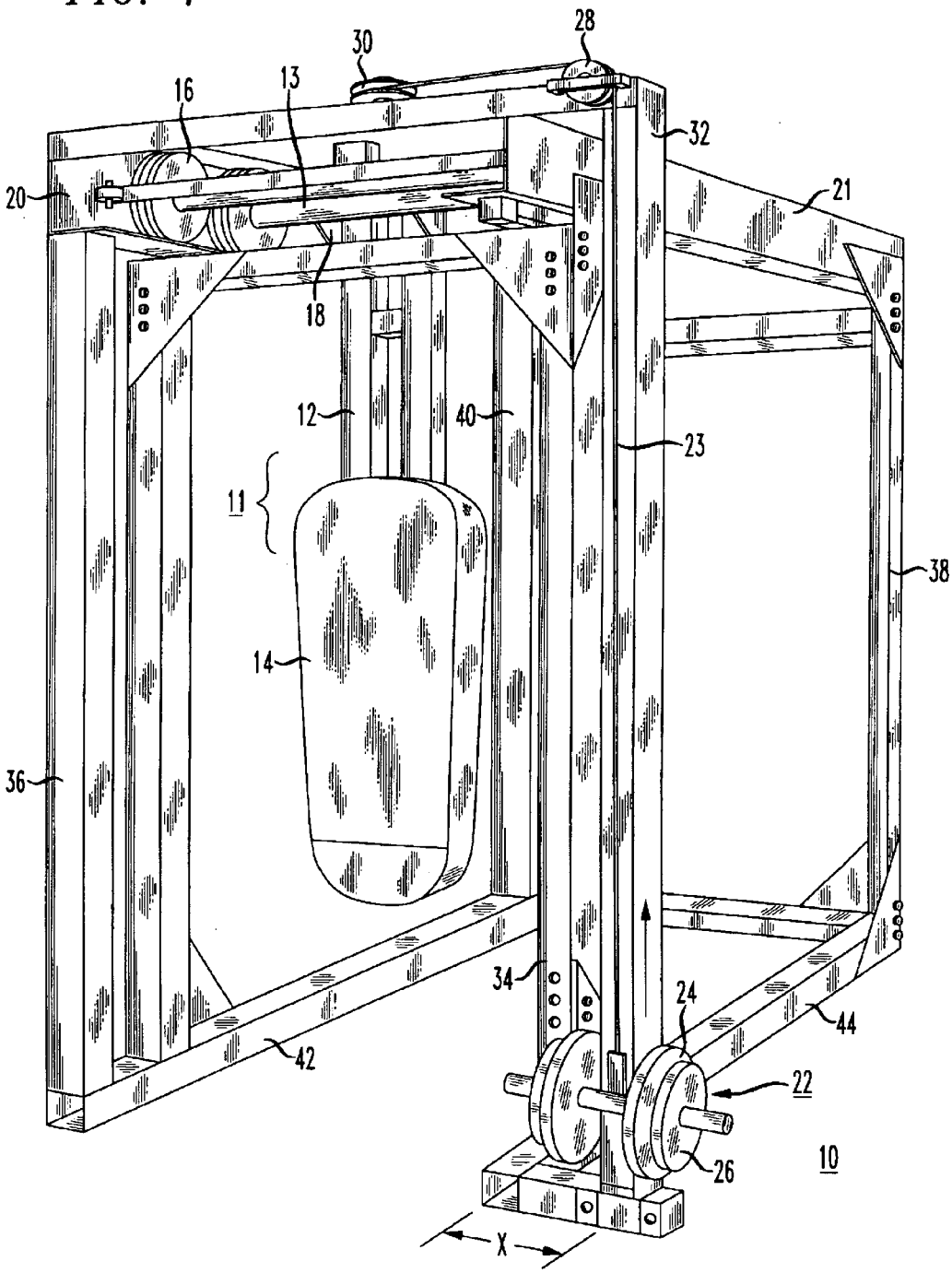
FIG. 1 is an isometric view of the full body, adjustable weight sled exerciser of the present invention.

FIG. 1 illustrates, in an isometric view, an exemplary sled exerciser 10 formed in accordance with the present invention. Sled exerciser 10 includes a vertical bar 12, including a long pad 14 mounted thereon, forming the movable sled 11 for exercising. As shown in FIG. 1, vertical bar 12 is attached, through a crossbar 13, to a set of wheels 16 and 18, disposed on either side of crossbar 13, where wheels 16 and 18 ride along a C-channel member 20. C-channel member 20 forms a top frame member of sled exerciser 10 and runs from the front to the back of exerciser 10. Wheels 16, 18 ride along C-channel member 20 and therefore provide movement to sled 11.

In accordance with the present invention, resistance must be provided against the movement of sled 11 to provide a workout for activities such as tackling or blocking. Therefore, an adjustable weight and pulley system is used to provide the resistance, where the number of weights used, and the values of the individual weights may be easily adjusted to suit a particular workout level. Referring to FIG. 1, a set of adjustable weights 22 (including, in this example, pairs of individual weights 24 and 26) is connected through a wire cable 23 to a pair of pulleys 28 and 30. As shown in FIG. 1, a separate frame member 32 may be disposed beyond a front frame member 34 supporting sled 11, where frame member 32 is used to support the pulley and weight assemblies, allowing weights 22 to be positioned outside of the actual use area of the system, as indicated in FIG. 1 by the legend "X", which shows the separation between weights 22 and frame 34 of system 10. It is to be understood, however, that pulleys 28 and 30 may also be attached to front frame member 34 (or, indeed, rear frame member 38) and still perform the resistance function required for the present invention. Alternatively, pulleys 28, 30 and weights 22 may be attached to either front frame member 36 or rear frame member 40 on the left-hand side of system 10. Indeed, an extension frame member (not shown), similar to frame 32, may be attached to front frame member 36 and used in a like fashion as in the arrangement shown in FIG. 1. In any arrangement, cable 23 passes through pulleys 28 and 30 and is then coupled to sled 11 to provide the necessary attachment between the adjustable weights and the sled.

In accordance with the present invention, and discussed below in association with FIG. 3, as an individual pushes against pad 14 on sled 11, the weights will rise (as indicated by the arrow in FIG. 1), and wheels 16, 18 will ride rearwardly along C-channel 20. The individual may then continue to push against pad 14, experiencing the resistance provided by weights 22, while also moving sled 11 toward the rear of system 10.

Figure 2:
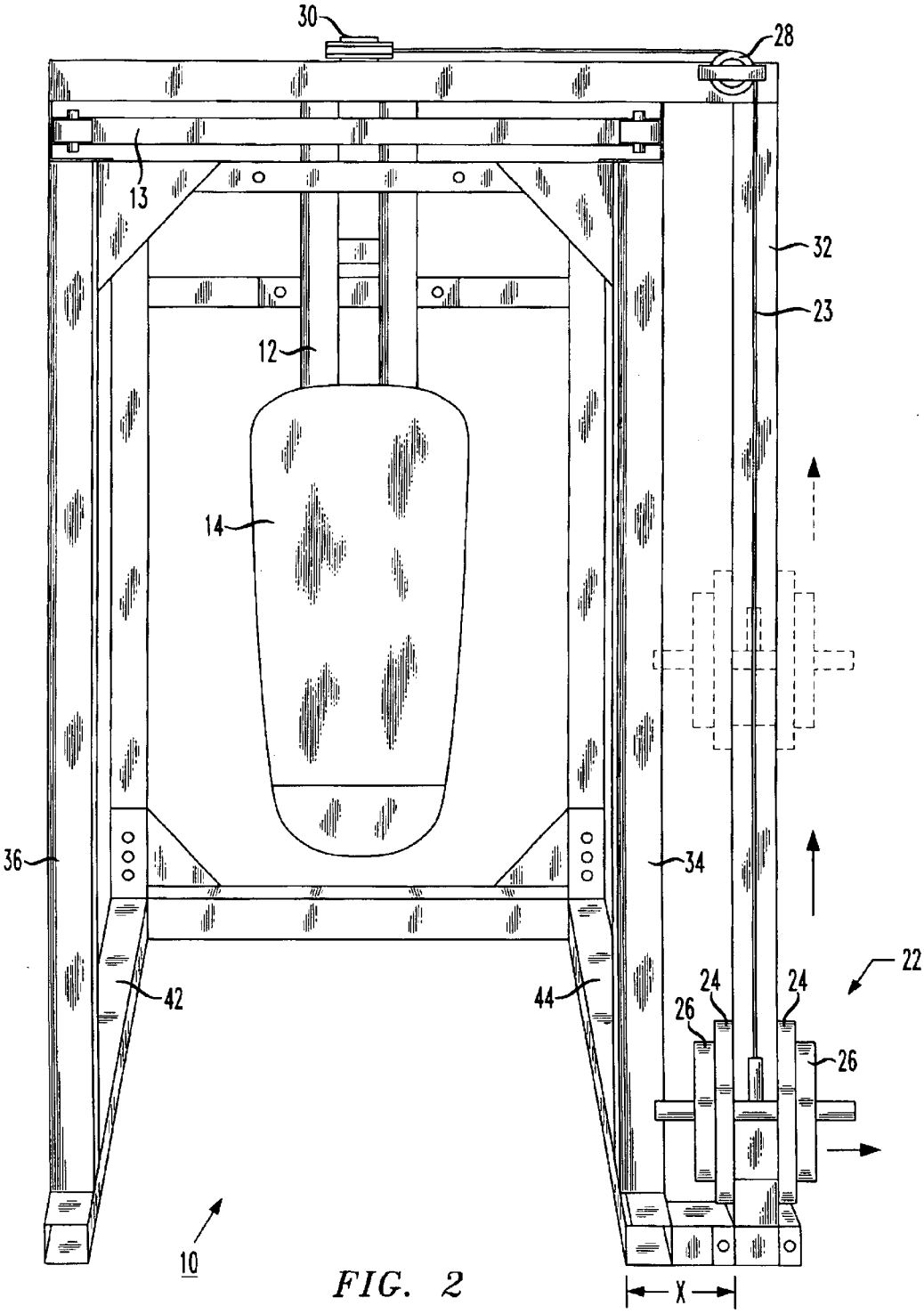
FIG. 2 is a front view of system, illustrating in particular the offset of the adjustable weights with respect to the frame supporting the sled exerciser.

FIG. 2 is a front view of sled exerciser 10, which clearly shows the preferred embodiment with weights 22 positioned beyond the working area of the system. That is, by using a frame member 32, the combination of weights 22, cable 23 and pulley 28 may be displaced out of the way of an individual using the sled exerciser system. An advantage of the exerciser arrangement of the present invention is that it is relatively simple to add or remove weights from set 22 to adjust the level of exercise required. System 10 of the present invention is, therefore, suitable for use by youths, adults, or even professional sports players.

Figure 3:
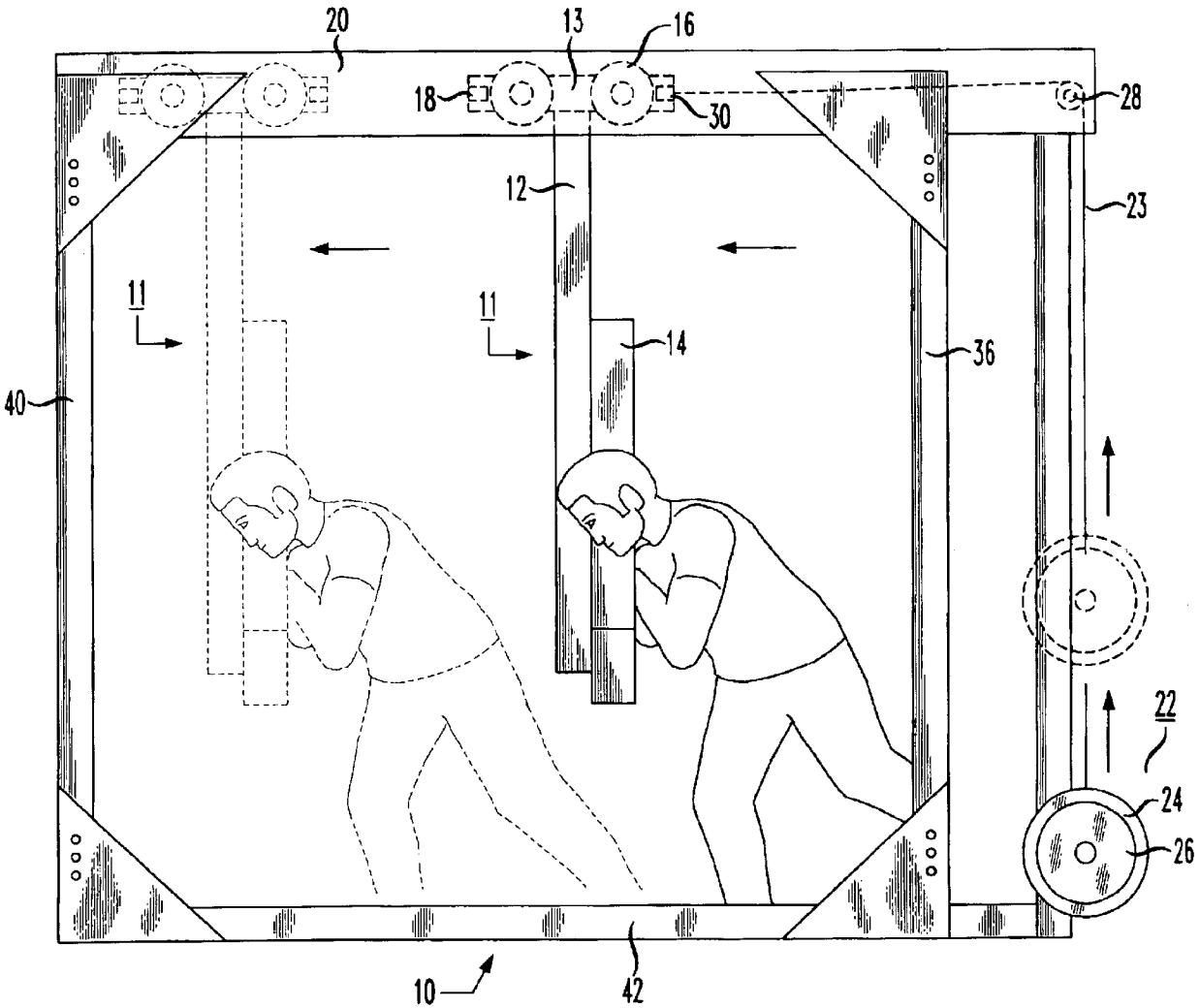
FIG. 3 is a side view of the sled exerciser of the present invention, illustrating the movement of the padded sled and adjustable weights when in use (as shown in phantom).

FIG. 3 is a side view of sled exerciser 10, showing the movement of sled 11 when being used by an individual. Illustrated in phantom is sled 11 after having been pushed rearward by the individual, as shown by the arrows. As sled 11 is pushed rearward, weights 22 will move upward, as shown in phantom, by virtue of the movement of cable 23 attached to pulleys 28 and 30. It is to be understood that an advantage of the sled exerciser 10 of the present invention is that while the individual moves sled 11 and obtains the necessary workout, the outer frame formed by frame members 20, 21, and 34–44 remain motionless, allowing for system 10 to be used indoors, such as in a gym or weight room. For added security, one or more frame members may be bolted to the floor (or a rear wall) to insure that system 10 does not move while being used.

Any appropriate material may be used to form the piece parts of system 10, where a heavy gauge steel is preferred for use in forming the frame members. In summary, system 10 of the present invention provides a simply, yet sturdy, adjustable sled exerciser that may be used by individuals of any age, while requiring a minimal amount of space.

What is claimed is:

1. An adjustable weight sled exerciser comprising a frame system including a pair of front and a pair of rear frame members, attached by a pair of floor members extending therebetween and further comprising an upper C-channel member disposed between a front frame member and a rear frame member;

a sled comprising a vertical bar with padding attached therefore, said sled including a crossbar extending from said vertical bar to the C-channel of said frame system;

a sled movement arrangement comprising at least a pair of wheels disposed within said C-channel and attached to either side of the sled crossbar, said movement arrangement thus allowing said sled to move longitudinally from the front to the rear of said exerciser, as said pair of wheels ride along said C-channel; and an adjustable weight system, attached to said sled, for providing resistance to the rearward longitudinal movement of said sled within said frame system.

2. The adjustable weight sled exerciser of claim 1 wherein the adjustable weight system comprises a set of adjustable free weights connected through a central bar piece to a first end of a cable; and a pulley system attached between the cable and the sled to couple a second, remaining end of said cable to said sled and provide adjustable resistance to the sled exerciser.

3. The adjustable weight sled exerciser of claim 2 wherein the pulley system comprises a first pulley, attached to a frame member; and a second pulley attached to the sled, wherein the cable is attached to and rides through said second pulley, and rides through said first pulley to provide adjustable resistance to the sled exerciser.

4. The adjustable weight sled exerciser of claim 1 wherein the exerciser further comprises an extension frame member for supporting the adjustable weight system at a predetermined distance separate from the frame system.

5. The adjustable weight sled exerciser of claim 4 wherein the extension frame member comprises an additional front frame member, attached to a front frame member using an extension piece to maintain a predetermined separation.

* * * * *